US007193573B2

(12) United States Patent
Durso et al.

(10) Patent No.: US 7,193,573 B2
(45) Date of Patent: Mar. 20, 2007

(54) WEARABLE CONFORMAL ANTENNA ASSEMBLY

(75) Inventors: Christopher M Durso, Carlsbad, CA (US); Alex David Dirdo, Vista, CA (US)

(73) Assignee: Pacific Microwave Research, Inc., Vista, CA (US)

( * ) Notice: Subject to any disclaimer, the term of this patent is extended or adjusted under 35 U.S.C. 154(b) by 5 days.

(21) Appl. No.: 11/172,763

(22) Filed: Jul. 2, 2005

(65) Prior Publication Data

US 2006/0001584 A1 Jan. 5, 2006

Related U.S. Application Data

(60) Provisional application No. 60/521,789, filed on Jul. 2, 2004.

(51) Int. Cl.
*H01Q 1/12* (2006.01)
*H01Q 1/38* (2006.01)

(52) U.S. Cl. ..... 343/718; 343/700 MS

(58) Field of Classification Search ..... 343/718, 343/702, 700 MS, 725, 727
See application file for complete search history.

(56) References Cited

U.S. PATENT DOCUMENTS 3,977,003 A * 8/1976 Kershaw ..... 343/702
5,886,667 A * 3/1999 Bondyopadhayay . 343/700 MS
6,356,773 B1 * 3/2002 Rinot ..... 455/575.1

* cited by examiner

*Primary Examiner*—Hoanganh Le
(74) *Attorney, Agent, or Firm*—Clifford B. Perry

(57) ABSTRACT

A conformal antenna assembly includes a radome layer, an antenna layer, and an isolation layer. The radome layer includes a first surface which is conformable to outer surface of the article to be worn, and a second surface, the first surface of the radome layer providing a protective, signal transparent barrier. The antenna layer is generally conformal to the second surface of the radome layer, and includes at least one antenna element disposed thereon for transmitting a signal at a predefined frequency. The isolation layer includes a first surface generally conformal to the antenna layer and a second surface, the isolation layer being operable to provide isolation of the transmitted signal between the antenna layer and the second surface of the isolation layer.

19 Claims, 2 Drawing Sheets

WEARABLE CONFORMAL ANTENNA ASSEMBLY

CROSS REFERENCE TO RELATED APPLICATIONS

This application claims the benefit of priority from U.S. Provisional Appl. No. 60/521,789, filed Jul. 2, 2004, the contents of which are herein incorporated by reference it is entirety for all purposes.

BACKGROUND

The present invention relates to antenna structures, and more specifically to conformal antenna assemblies which provide high isolation so as to be safely worn.

Conformal antenna systems are known in the art, primarily in the application of aircraft antenna systems and other avionic areas. In such applications, antenna systems are shaped to conform to the shape of the structure, typically to preserve the aerodynamics of the structure itself.

An additional application of conformal antenna systems is in the area of wearable antenna assemblies in which the antenna is carried on the body, perhaps in a protective helmet, to enable the wearer to communicate to a remote station. Possible applications include military personnel and first responders, e.g., fireman or police personnel who could benefit from using a wearable communication system as opposed to carrying a separate communication system. Such a system presents challenges, however, in that the wearer must be protected from the transmitted signal, which could be of relatively high strength.

Accordingly, what is needed is a conformal antenna which can be shaped to protective articles of clothing and which is constructed in such a way as to exhibit sufficient isolation to be safely worn.

SUMMARY

The present invention provides a conformal antenna assembly which is designed to be integrated into an article of clothing and is construction in a manner so as to provide very high signal isolation to be safely worn. The system can be integrated into protective articles, such as a helmet, to provide a transmitting and/or receiving capability to the wearer.

In a particular embodiment, the conformal antenna assembly includes a radome layer, an antenna layer, and an isolation layer. The radome layer includes a first surface which is conformable to outer surface of the article to be worn, and a second surface, the first surface of the radome layer providing a protective, signal transparent barrier. The antenna layer is generally conformal to the second surface of the radome layer, and includes at least one antenna element disposed thereon for transmitting a signal at a predefined frequency. The isolation layer includes a first surface generally conformal to the antenna layer and a second surface, the isolation layer being operable to provide isolation of the transmitted signal between the antenna layer and the second surface of the isolation layer.

These and other features of the inventions will be better understood in light of the following drawings and detailed description of exemplary embodiments.

For clarity, previously identified features retain their reference indicia in subsequent drawings.

DETAILED DESCRIPTION OF EXEMPLARY EMBODIMENTS

Figure 1:
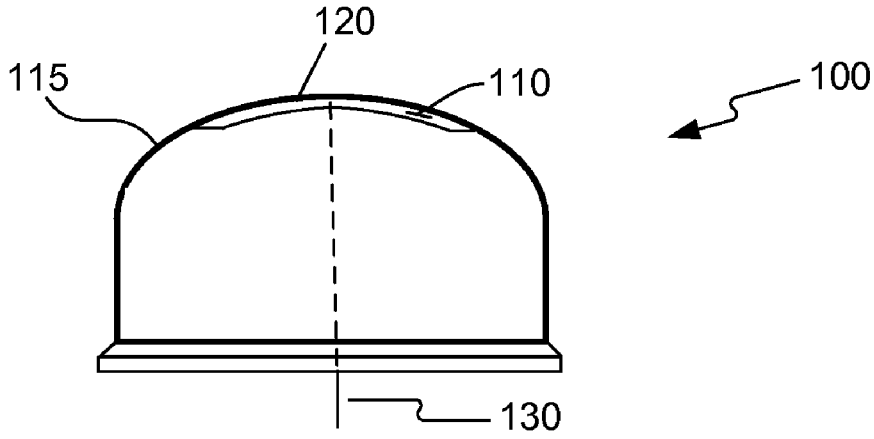
FIG. 1 illustrates a front view of a protective helmet employing the conformal antenna assembly in accordance with one embodiment of the present invention.

FIG. 1 illustrates a front view of a protective helmet 100 employing the conformal antenna assembly in accordance with the present invention. The protective helmet 100 includes a crown section having a recessed portion 110 within which a conformal antenna assembly of the present invention 120 is integrated, the exterior (radome layer) of the antenna assembly 120 being substantially conformal to the non-recessed crown section 115 of the protective helmet 100. The helmet 100 further includes a connecting cable 130 for providing a signal connection between the conformal antenna assembly 120 and radio transmitter/receiver circuitry (not shown).

Figure 2:
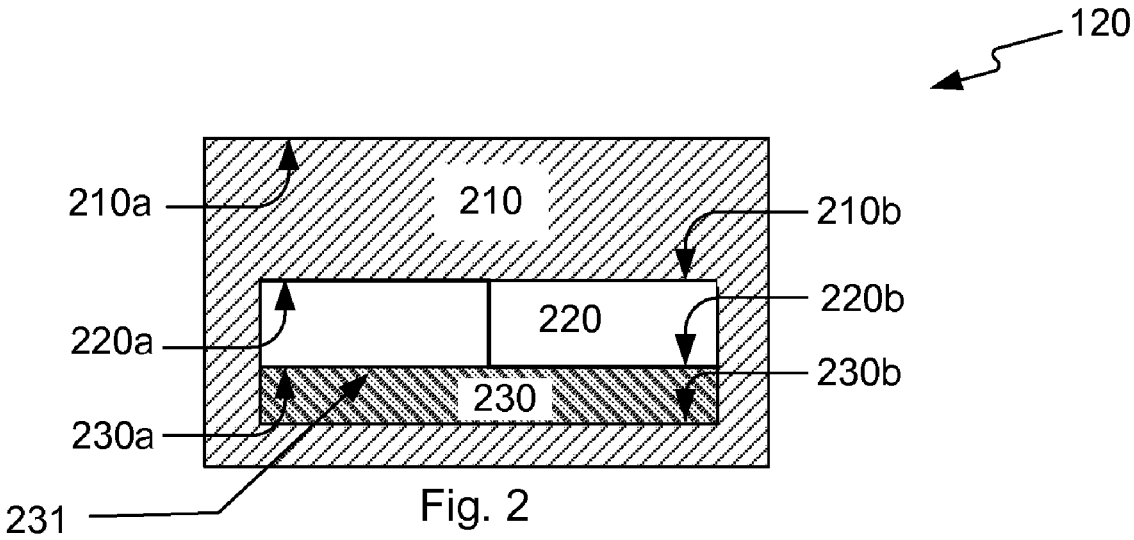
FIG. 2 illustrates a cross-sectional view of an exemplary conformal antenna assembly in accordance with the present invention.

FIG. 2 illustrates a cross-sectional view of the conformal antenna assembly 120 in accordance with the present invention. The assembly 120 includes a radome layer 210, an antenna layer 220, and an isolation layer 230. The antenna layer 220 includes top and bottom circuit traces and a vertical via (shown in bold lining) as will be further described below.

The radome layer 210 includes an exterior surface 210*a* which is conformable to outer surface of the article to be worn, and an interior surface 210*b*, the exterior surface 210*a* of the radome layer operable to provide a protective, signal transparent barrier to the antenna layer 220. In the exemplary embodiment shown, the radome layer 210 envelopes the antenna and isolation layer 220 and 230 along the sides and bottom surfaces to further provide protection against environmental elements. In a particular embodiment, the radome layer 210 is formed from a polypropylene- or polyurethane-impregnated cloth, an example being type 600 poly water resistant polyurethane cloth manufactured by Huber Textiles of Fallston, N.C. Generally, the radome layer 210 is operable to provide a substantially signal transparent barrier, providing less than 0.5 dB signal loss to the transmitted signal, and in a further particular embodiment, provides less than 0.1 dB signal loss. In the illustrated exemplary embodiment, the radome layer 210 is directly adjacent to the first surface 220*a* of the antenna layer 220. In this instance, the radome layer interior surface 210*b* can be securely attached to the antenna layer first surface 220*a* by an adhesive. Alternatively, one or more intermediate layers having a high degree of signal transparency may be interposed between the radome and antenna layers 210 and 220. In an exemplary embodiment of this option, a protective, signal transparent conformal coating is deposited over at least the antenna layer top (first) surface 220*a*.

The antenna layer 220 includes first and second surfaces 220*a* and 220*b*, and is positioned generally conformal to the radome layer second surface 210*b*. In an exemplary embodiment further described below, the antenna layer first surface

220*a* includes at least one antenna element for transmitting a signal at a predefined frequency, the isolation from which is needed.

The isolation layer 230 includes first and second surfaces 230*a* and 230*b*, and is positioned generally conformal to the antenna layer 220. The isolation layer is primarily operable to provide high isolation to the wearer from signals transmitted from the antenna layer 220. In a particular embodiment, the isolation layer is a non-woven Ni—Cu polyester material, such as product no. 3027-217 available from Laird Technologies of San Diego, Calif. Using an adhesive, the isolation layer first surface 230*a* can be attached to the antenna layer bottom surface 220*b*, and the isolation layer second surface 230*b* can be attached to radome layer interior surface 210*b*.

The amount of isolation from the transmitted signal will vary depending upon the transmitted signal's frequency and power level. In one embodiment, the isolation layer 230 provides a minimum of 30 dB signal isolation below the isolation layer 230 to protect the wearer (measured from the antenna layer first surface 220*a* and the isolation layer second surface 230*b*), and in a further particular embodiment, minimum signal isolation ranges between 40 dB to 90 dB. Further, while one isolation layer 230 is employed directly adjacent the antenna layer 220 as shown in FIG. 2, one or more intermediate layers 231 may be interposed therebetween to provide additional isolation, or to meet an overall isolation requirement when using layers of lower isolation values.

Figure 3:
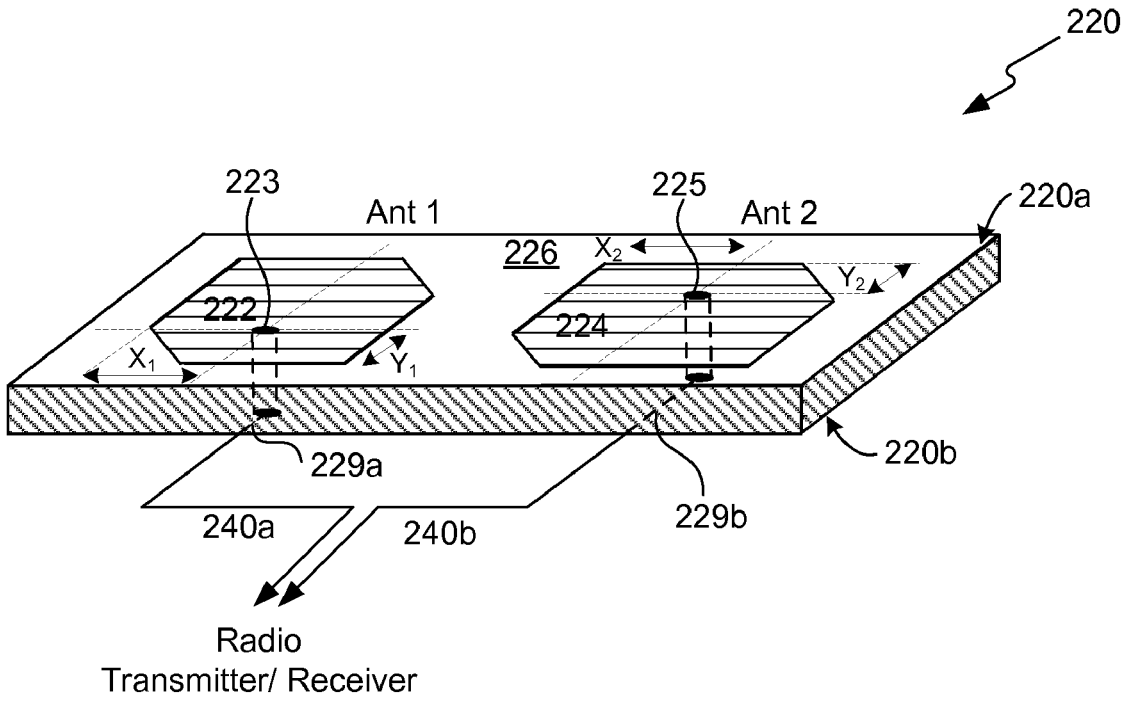
FIG. 3 illustrates an exemplary embodiment of an antenna layer in accordance with the present invention.

FIG. 3 illustrates an exemplary embodiment of the antenna layer 220 in accordance with the present invention. The antenna layer 220 includes two antenna elements Ant 1 222 and Ant 2 224 which are disposed onto a flexible substrate material 226. In a particular embodiment, the substrate material 226 has conductive material (e.g., copper) disposed on both top and bottom sides which can be etched to form the antenna elements and feed lines on respective sides. The exemplary antenna elements 222 and 224 include opposite-edge miters to facilitate transmission and reception of circularly polarized signals. While two antenna elements are shown, those skilled in the art will appreciate that three of more antenna elements may be used in alternative embodiments of the present invention.

As shown, the antenna layer 220 includes a first plated-through via 223 coupled between the first antenna element 222 and a first feed line 229*a* formed on bottom surface. The first plated-through via 223 is offset from its left x-axis at location $X_1$, and is offset from its foreground edge by a distance, $Y_1$. The antenna layer 220 further includes a second plated-through via 225 coupled between the second antenna element 224 and a second feed line 229*b*, the plated-through via 225 being located at coordinates $(X_2, Y_2)$. The size and shape of the particular antenna element (222 or 224), and location of the element's plated-through via (223 or 225) largely determine the band over which the antenna will communicate. In one exemplary embodiment, and Ant 1 222 is an IRIDUM network capable antenna operable to transmit and receive right hand circularly polarized signals in the range of 1623.5 MHz. In this embodiment Ant 1 measures substantially 53 $mm^2$, and includes a 0.6 mm diameter plated-through via 223 located 17.5 mm from the foreground edge. Further exemplary, Ant 2 224 is an L1-band Global Positioning System (GPS) network-capable antenna operable to receive right hand circularly polarized signals in the range of 1561 MHz. In this embodiment Ant 2 measures substantially 54.5 $mm^2$, and includes a 0.6 mm diameter plated-through via 225 located 16 mm from the background edge. Conformal substrate 226 in an exemplary embodiment is ROGERS® 3003 flexible substrate material, consisting of 1.5 mm thick duriod material and having a relative dielectric constant of 3.0, with 1 oz. copper under solder plating available from Rogers Corporation of Rogers, Conn. In these embodiments, each antenna is formed to have a characteristic impedance of substantially 50 ohms with a return loss of at least −10 dB over the operating range and is operable to exhibit 1.5–2.0 dBi directional gain. Those skilled in the art will appreciate that the foregoing frequency bands and dimensions are exemplary, and antenna elements of different sizes and operational frequency bands may be used in accordance with the present invention. For example, the dimension of the antenna pattern can be chosen to be generally $\lambda/2$ square, and the location of the plated through vias selected to be generally centered and off-set from one edge generally $\lambda/10$, the plated-through vias offset from alternate edges of adjacent-located antenna elements.

First and second feed lines 229*a* and 229*b* are coupled to an antenna feed 240, which is coupled to a radio transmitter/receiver. In an exemplary embodiment, the antenna feed 240 is made up of two 50 ohm low-loss ruggedized coaxial cables 240*a* and 240*b* encased in a common expandable braided polyester cover to protect the cables from the environment. Further, the distal end of coaxial cables 240*a* and 240*b* include distinguishable (e.g., color- or shaped-coded) quick-release radio frequency connectors to facilitate connection and disconnection from the radio set(s) without the need for any tools.

While the invention has been described in terms of relatively high transmitting power applications by means of a helmet-based antenna system, those skilled in the art will appreciate that the same assembly can be used for lower transmitting power applications such as WiFi or Bluetooth, and by means of other wearable articles such as an outer jacket, shoes, or accessories.

The foregoing description has been presented for purposes of illustration and description. It is not intended to be exhaustive or to limit the invention to the precise form disclosed, and obviously many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A wearable conformal antenna assembly for integration into an article of clothing, comprising:

a radome layer having a first surface which is conformable to outer surface of the article to be worn and a second surface, the first surface of the radome layer operable to provide a protective, signal transparent barrier;

an antenna layer generally conformal to the second surface of the radome layer, the antenna layer having at least one antenna element disposed thereon for transmitting a signal at a predefined frequency; and an isolation layer having a first surface generally conformal to the antenna layer, and a second surface, the isolation layer operable to provide isolation of the transmitted signal between the antenna layer and the second surface of the isolation layer, wherein the antenna layer comprises a first antenna element for transmitting the signal at the predefined frequency, and a second antenna element operable at a second predefined frequency.

2. The wearable conformal antenna assembly of claim 1, wherein the radome layer comprises a polypropylene- or polyurethane-impregnated cloth.

3. The wearable conformal antenna assembly of claim 1, wherein the isolation layer comprises a Nickel/Copper polyester nonwoven material.

4. The wearable conformal antenna assembly of claim 1, wherein the antenna layer comprises a first surface generally conformal to the second surface of the radome layer, and a second surface, the first surface of the antenna layer comprising the first and second antenna elements, and the second surface of the antenna layer comprising first and second feed lines, the antenna layer further comprising a first plated-through via coupled between the first antenna element and the first feed line, and a second plated-through via coupled between the second antenna element and the second feed line.

5. The wearable conformal antenna assembly of claim 1, wherein the isolation layer is operable to provide at least 30 dB of isolation of the transmitted signal as measured from the first surface of the antenna layer to the second surface of the isolation layer.

6. The wearable conformal antenna assembly of claim 1, further comprising at least one intermediate layer positioned between the second surface of the antenna layer and the first surface of the isolation layer.

7. The wearable conformal antenna assembly of claim 6, wherein the at least one intermediate layer contributes to the total effective isolation provided between the first surface of the antenna layer and the second surface of the isolation layer.

8. A wearable conformal antenna assembly for integration into an article of clothing, comprising:

a radome layer having a first surface which is conformable to outer surface of the article to be worn and a second surface, the first surface of the radome layer operable to provide a protective, signal transparent barrier;

an antenna layer generally conformal to the second surface of the radome layer, the antenna layer having at least a first antenna element disposed thereon for transmitting a signal at a predefined frequency and a second antenna element disposed thereon for receiving a signal at a second frequency; and an isolation layer having a first surface generally conformal to the antenna layer, and a second surface, the isolation layer operable to provide isolation of the transmitted signal between the antenna layer and the second surface of the isolation layer.

9. The wearable conformal antenna assembly of claim 8, wherein the radome layer comprises a polypropylene- or polyurethane-impregnated cloth.

10. The wearable conformal antenna assembly of claim 8, wherein the isolation layer comprises a Nickel/Copper polyester nonwoven material.

11. The wearable conformal antenna assembly of claim 8, wherein the antenna layer comprises a first surface generally conformal to the second surface of the radome layer, and a second surface, the first surface of the antenna layer comprising the first and second antenna elements, and the second surface of the antenna layer comprising first and second feed lines, the antenna layer further comprising a first plated-through via coupled between the first antenna element and the first feed line, and a second plated-through via coupled between the second antenna element and the second feed line.

12. The wearable conformal antenna assembly of claim 8, wherein the transmitted signal comprises a circularly polarized signal and wherein the second antenna element is operable to receive a circularly polarized signal.

13. The wearable conformal antenna assembly of claim 8, wherein the isolation layer is operable to provide at least 30 dB of isolation of the transmitted signal as measured from the first surface of the antenna layer to the second surface of the isolation layer.

14. The wearable conformal antenna assembly of claim 8, further comprising at least one intermediate layer positioned between the second surface of the antenna layer and the first surface of the isolation layer.

15. The wearable conformal antenna assembly of claim 14, wherein the at least one intermediate layer contributes to the total effective isolation provided between the first surface of the antenna layer and the second surface of the isolation layer.

16. A helmet-based antenna assembly, comprising:

a helmet having a recessed crown section and a non-recessed crown section; and a conformal antenna assembly integrated into the recessed crown section of the helmet, the conformal antenna assembly comprising:

a radome layer having a first surface which is substantially conformal to outer surface of the non-recessed crown section of the helmet and a second surface, the first surface of the radome layer operable to provide a protective, signal transparent barrier;

an antenna layer generally conformal to the second surface of the radome layer, the antenna layer having at least one antenna element disposed thereon for transmitting a signal at a predefined frequency; and an isolation layer having a first surface generally conformal to the antenna layer, and a second surface, the isolation layer operable to provide isolation of the transmitted signal between the antenna layer and the second surface of the isolation layer.

17. The helmet-based antenna assembly of claim 16, wherein the antenna layer comprises a first antenna element for transmitting the signal at the predefined frequency, and a second antenna element.

18. The helmet-based antenna assembly of claim 17, wherein the antenna layer comprises a first surface generally conformal to the second surface of the radome layer, and a second surface, the first surface of the antenna layer comprising the first and second antenna elements, and the second surface of the antenna layer comprising first and second feed lines, the antenna layer further comprising a first plated-through via coupled between the first antenna element and the first feed line, and a second plated-through via coupled between the second antenna element and the second feed line.

19. The helmet-based antenna assembly of claim 18, further comprising a first antenna cable coupled to the first feed line, and a second antenna cable coupled to the second feed line.

* * * * *